US005494260A

United States Patent [19]

Huang

[11] Patent Number: 5,494,260

[45] Date of Patent: Feb. 27, 1996

[54] STAPLE REMOVER

[76] Inventor: Jackson Huang, No. 162-1, Sanchiao Rd., Pingho Tsun, Tatsun Hsiang, Changhua Hsien, Taiwan

[21] Appl. No.: 294,656

[22] Filed: Aug. 23, 1994

[51] Int. Cl.[6] ..... B25C 11/00

[52] U.S. Cl. ..... 254/28

[58] Field of Search ..... 254/28, 23, 24; 7/125, 166

[56] References Cited

U.S. PATENT DOCUMENTS 3,494,591 2/1970 Fleming ..... 254/28

FOREIGN PATENT DOCUMENTS 2513035 10/1976 Germany ..... 254/28

*Primary Examiner*—Robert C. Watson

*Attorney, Agent, or Firm*—Hamilton, Brook, Smith & Reynolds

[57] ABSTRACT

A staple remover includes a first arm and a second arm pivotally engaged at each second end thereof by engaging two projections extending from two side walls of the first arm into two recesses defined in two side walls of the second arm and a spring element is disposed between the two arms. A hook element is engaged to the first end of the respective arm, the hook element having two flanges extending horizontally from both sides thereof and the flanges received in two slots defined in the side walls of the first end of each of the two arms. Each arm has a boss projecting from a bottom thereof to engage to a hole defined in the hook element.

5 Claims, 3 Drawing Sheets

STAPLE REMOVER

BACKGROUND OF THE INVENTION

The present invention relates to a staple remover and more particularly, to a staple remover having first and second arms each with a replaceable hook element disposed thereto and the two arms pivotally engaged together by engaging a protrusion extending from the first arm to a recess defined in the second arm.

A conventional staple remover shown in FIG. 1 is designed to remove staples from papers, includes first and second arms 50 and 60 pivotally engaged at each first end thereof by a rivet 70. Each of the first and second arms 50 and 60 includes a respective metal element 51, 61 and a respective plastic element 52, 62, the metal elements 51, 61 each have a pair hooks 53, 63 at a respective second end thereof and the plastic elements 52, 62 are each securely mounted on the respective metal elements 51, 61 by rivets 54, 64. A spring element 80 is disposed between an inner side of each of the arms 50, 60 to urge the two arms 50, 60 to be opened wide at second ends thereof.

A first shortcoming of the conventional staple remover is that it has a heavy weight because the metal arms form at least half of the remover and that results in inconvenience in use, a second shortcoming thereof is that all the elements of the staple remover are engaged together by rivets and that means there is no possibility of replacing any one of the elements when damaged.

The present invention intends to provide a staple remover which is assembled by replaceable structure to mitigate and/or obviate the above-mentioned problems.

The present invention provides a staple remover which includes first and second arms each having first and second ends, the two arms pivotally engaged at each second end thereof by engaging two projections extending from two side walls of the first arm into two recesses defined in two side walls of the second arm and a spring element is disposed between the two arms. A hook element is disposed to the first end of each arm by sliding a flange extending from the hook element into a slot defined in the side wall of the first end of the arm and engaging a hole defined in the hook element to a boss extending from the arm.

It is an object of the present invention to provide a staple remover which has a simple structure and its components are replaceable.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
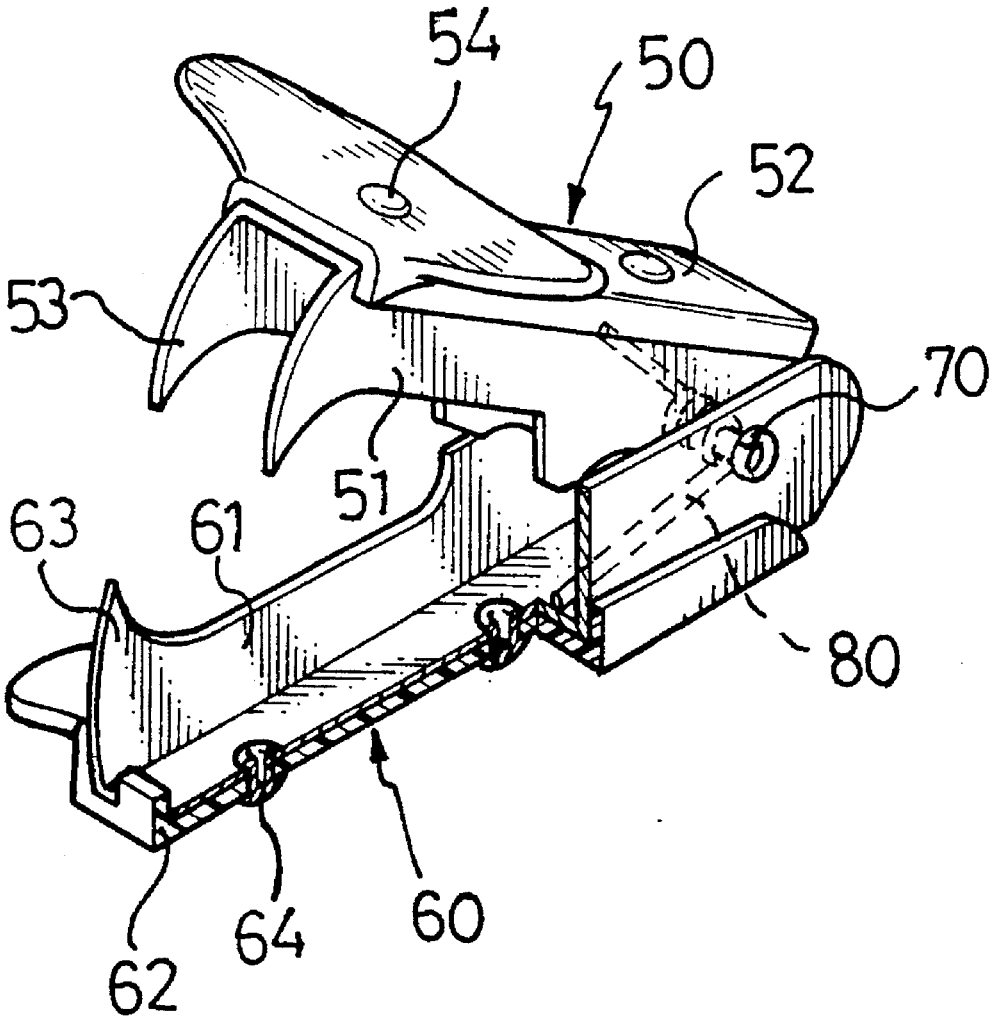
FIG. 1 PRIOR ART
FIG. 1 is a perspective view, partly in section, of a conventional staple remover.
Figure 2:
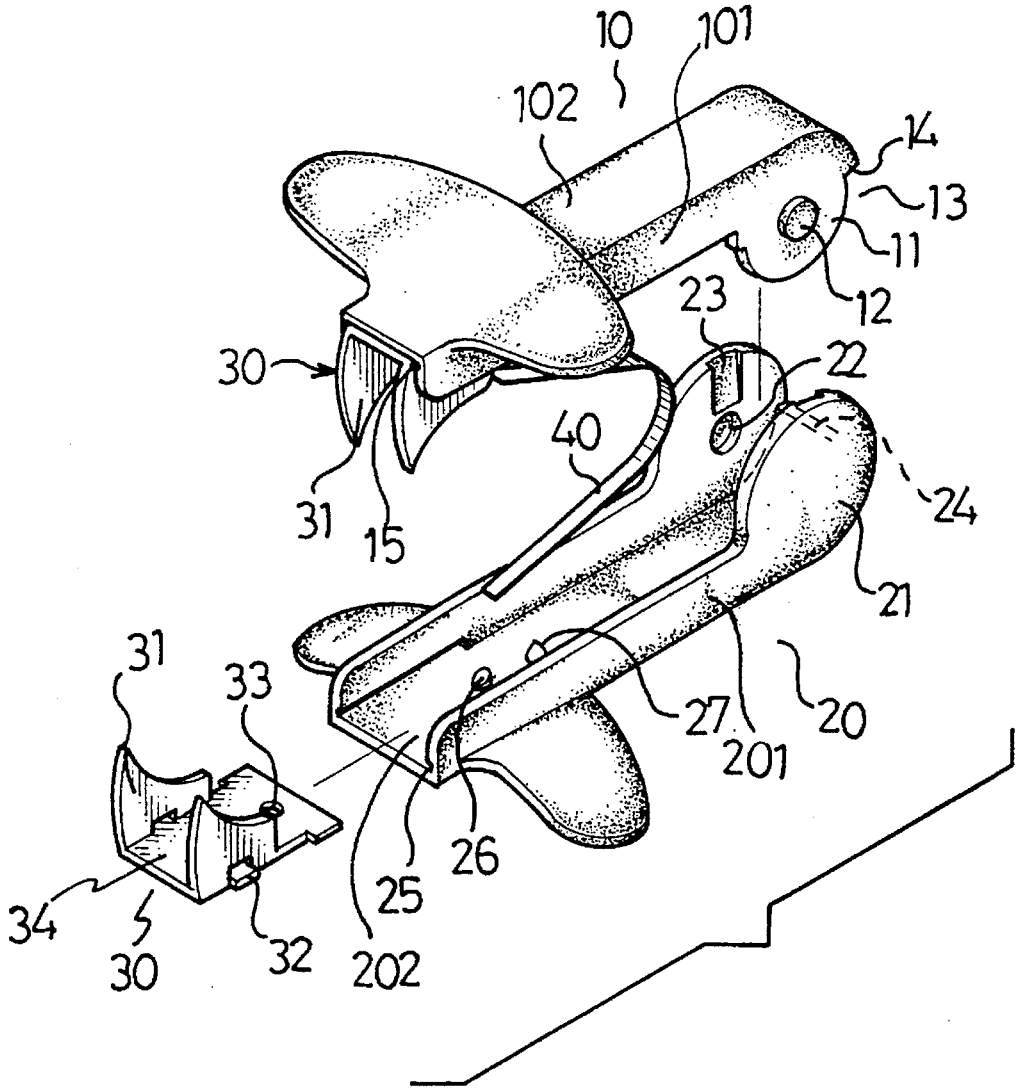
FIG. 2 is an exploded view of a staple remover in accordance with the present invention.
Figure 3:
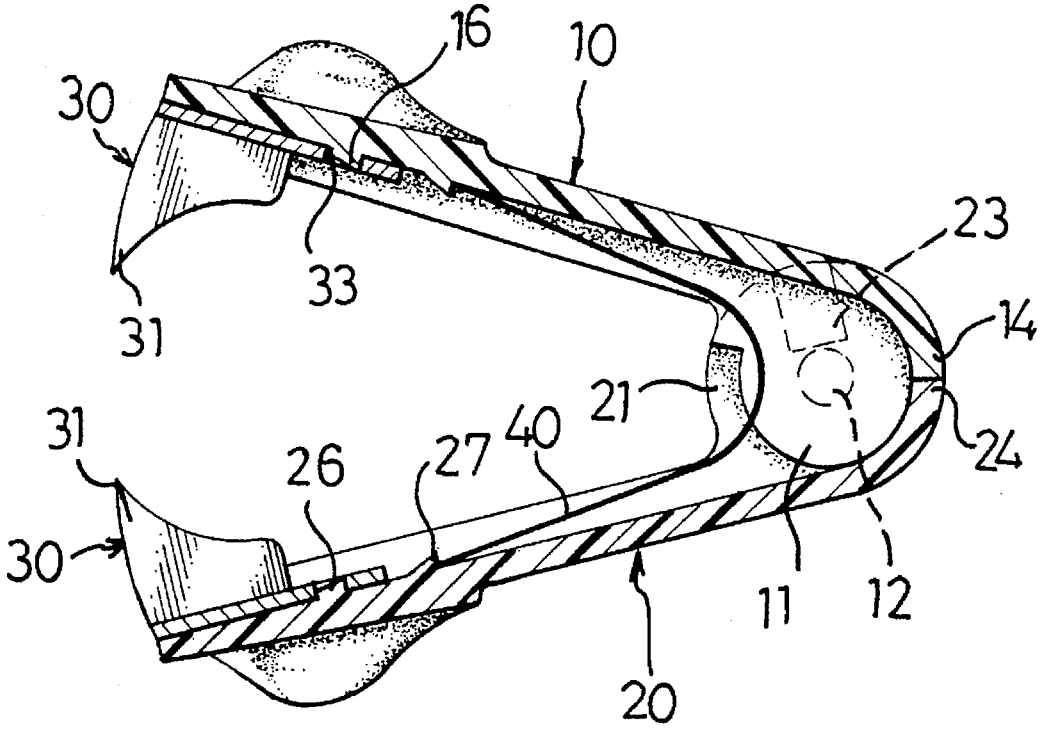
FIG. 3 is a side elevational view, partly in section, of the staple remover in accordance with the present invention.

Referring to FIGS. 2 and 3, a staple remover in accordance with the present invention generally includes first and second arms 10 and 20, each has first and second ends, two side walls 101/201 and a bottom 102/202 between two side walls 101/201. Each side wall 101/201 of the arms 10/20 has a lug 11/21 extending therefrom at second ends thereof, a projection 12 projects outwardly from an outer surface of each lug 11 of the first arm 10, a first recess 22 is defined in an inner surface of each lug 21 of the second arm 20 and a second recess 23 is defined above each first recess 22, which is defined by a bottom tapering to the inner surface of the lug 21 near the first recess 22 such that each projection 12 is received in one of the second recesses 22 via sliding through one of the corresponding second recesses 23 to pivotally engage the first and second arms 10 and 20 at the second ends thereof. A flange 14 extends outwardly from the second end of the first arm 10 thereof and engages with an end 24 terminated between two lugs 21 of the bottom 202 of the second arm 20 to restrict the angle of the two arms 10 and 20. A spring element 40 having a U-shaped configuration is disposed between the first and second arms 10 and 20 to urge the two arms 10 and 20 open, a stop 27 extends from the respective bottoms 102 and 202 of the arms 10 and 20 against which two ends of the spring element 40 is disposed. A slot 15/25 is defined in a base of each side walls 101/201 near the bottom 102/202 and each of the bottoms 102/202 has a boss 16/26 projecting vertically therefrom and an inclined top surface is defined on each of the bosses 16/26.

Two hook elements 30 each have two hooks 31 and a bottom plate 34 in which a hole 33 is defined and two flanges 32 extend outwardly from the bottom plates 34. The hook elements 30 are each engaged to the first ends of each of the two arms 10/20 by inserting the flanges 32 in the respective slots 15/25 and the holes 33 each receive to the respective boss 16/26 after passing the inclined top surface thereof such that the hook element 30 is securely engaged to the arm 10/20.

Accordingly, the staple remover in accordance with the present invention can be reassembled and the weight thereof is light because only the hook element 30 which has small volume compared with the conventional stapler and the spring element 40 are made of metal.

Although the invention has been explained in relation to its preferred embodiment, it is to be understood that many other possible modifications and variations can be made without departing from the spirit and scope of the invention as hereinafter claimed.

I claim:

1. A staple remover comprising:

a first arm and a second arm, each arm having first and second ends, a bottom and two side walls extending therefrom, a slot defined in each said side wall at said first end thereof and a boss projecting from said bottom of each said arm and having an inclined top surface formed thereon; said first arm pivotally engaged to said second arm at two second ends thereof and a spring element disposed therebetween;

two hook elements each comprising a bottom plate and two hooks extending from said bottom plate, a hole defined in said bottom plate and at least one flange extending horizontally from a side of said bottom plate, said first and second arms each engaging said hook element respectively by slidably engaging each said flange thereof to said slot of said respective arm and engaging each said hole thereof to said boss of said respective arm.

2. The staple remover as claimed in claim 1 wherein said second end of said first arm has a projection extending outward from an outer surface of each said side wall thereof and said second end of said second arm has a first recess defined in an inner side of each said side wall thereof for receiving said projection.

3. The staple remover as claimed in claim 2 wherein each said side wall of said second end of said second arm has a second recess defined in said inner surface of said side wall thereof and above said first recess.

4. A staple remover comprising:

a first arm and a second arm, each arm having first and second ends, a bottom and two side walls extending therefrom, a slot defined in each said side wall at said first end thereof and a boss projecting from said bottom of each said arm and having an inclined top surface formed thereon; said first arm pivotally engaged to said second arm at second ends thereof and a spring element disposed therebetween;

two hook elements, each comprising a bottom plate and two hooks extending from said bottom plate, a hole defined in said bottom plate and at least one flange extending horizontally from a side of said bottom plate, said first and second arms each engaging said hook element respectively by slidably engaging each said flange thereof to said slot of said respective arm and engaging each said hole thereof to said boss of said respective arm; and said second end of said first arm has a projection extending outward from an outer surface of each said side wall thereof and said second end of said second arm having a first recess defined in an inner surface of each said side wall thereof for receiving said projection.

5. The staple remover as claimed in claim 4 wherein each said side wall of said second end of said second arm has a second recess defined in said inner surface of said side wall thereof and above said first recess.

* * * * *